US012532934B2

(12) United States Patent
Cheng

(10) Patent No.: US 12,532,934 B2
(45) **Date of Patent: *Jan. 27, 2026**

(54) ATTACHMENT AND ATTACHMENT SYSTEM FOR A HELMET

(71) Applicant: STRATEGIC SPORTS LIMITED, Pok Fu Lam (HK)

(72) Inventor: Tien Hou Cheng, Kowloon (HK)

(73) Assignee: STRATEGIC SPORTS LIMITED, Pok Fu Lam (HK)

( * ) Notice: Subject to any disclaimer, the term of this patent is extended or adjusted under 35 U.S.C. 154(b) by 123 days.

This patent is subject to a terminal disclaimer.

(21) Appl. No.: 17/734,352

(22) Filed: May 2, 2022

(65) Prior Publication Data

US 2022/0295933 A1 Sep. 22, 2022

Related U.S. Application Data

(63) Continuation of application No. 14/339,455, filed on Jul. 24, 2014, now Pat. No. 11,317,673.

(60) Provisional application No. 62/004,745, filed on May 29, 2014.

(51) Int. Cl.

| | |
|---|---|
| ***A42B 3/04*** | (2006.01) |
| ***A42B 3/08*** | (2006.01) |
| ***A42B 3/12*** | (2006.01) |
| ***A42B 3/28*** | (2006.01) |

(52) U.S. Cl.

CPC ..... *A42B 3/0406* (2013.01); *A42B 3/04* (2013.01); *A42B 3/0446* (2013.01); *A42B 3/08* (2013.01); *A42B 3/125* (2013.01); *A42B 3/283* (2013.01); *A42B 3/0493* (2013.01)

(58) Field of Classification Search

CPC ..... A42B 3/0406; A42B 3/04; A42B 3/0446; A42B 3/044; A42B 3/08; A42B 3/125; A42B 3/283; A42B 3/328; A42B 3/0433; A42B 1/24; A42B 1/248; A42B 1/004; A42B 3/0493; A41D 27/08; A41D 27/085; A42C 5/00

USPC ..... 2/422, 244, 245, 246

See application file for complete search history.

(56) References Cited

U.S. PATENT DOCUMENTS

| | | | | | |
|---|---|---|---|---|---|
| 315,418 | A * | 4/1885 | Krementz | A44B 3/02 | 79/2 |
| 1,691,064 | A * | 11/1928 | Hoppe | A43C 11/24 | 411/338 |
| 1,888,169 | A * | 11/1932 | Hollerer | A44B 1/34 | 24/104 |
| 3,106,716 | A * | 10/1963 | Beebe | A42B 3/20 | 2/9 |

(Continued)

FOREIGN PATENT DOCUMENTS

| | | | | |
|---|---|---|---|---|
| FR | 2921802 A1 * | 4/2009 | ..... | A42B 3/0406 |
| WO | WO-2010096839 A2 * | 8/2010 | ..... | A43B 1/0027 |

OTHER PUBLICATIONS

FR2921802 English translation (Doc pub Apr. 2009) (Year: 2009).*

*Primary Examiner* — Amy Vanatta

(74) *Attorney, Agent, or Firm* — Daniel F. Nesbitt; Nesbitt IP LLC

(57) ABSTRACT

An attachment for a helmet includes an external portion, an internal portion distal from the external portion, and a shaft extending between the external portion and the internal portion. The external portion contains an object to be attached to the helmet. An attachment system including a helmet is also described.

12 Claims, 2 Drawing Sheets

(56) References Cited

U.S. PATENT DOCUMENTS 3,274,613 A * 9/1966 Sowle ..... A42B 3/20 2/9
3,815,152 A * 6/1974 Bednarczuk ..... A42B 3/08 2/9
4,282,610 A * 8/1981 Steigerwald ..... A42B 3/127 2/414
4,692,947 A * 9/1987 Black ..... A42B 3/08 2/9
5,978,973 A * 11/1999 Chartrand ..... A42B 3/20 2/424
6,488,151 B2 * 12/2002 Ramsey ..... B25H 3/06 206/378
6,718,559 B1 * 4/2004 Davidson ..... G09F 21/02 24/324
7,234,411 B1 * 6/2007 Butler ..... G09F 21/02 116/28 R
7,698,836 B2 * 4/2010 Schmelzer ..... A43B 23/24 36/137
D625,052 S * 10/2010 Mastoras ..... D29/122
8,763,163 B1 * 7/2014 Johns ..... A42B 1/22 2/200.1
2007/0084019 A1 * 4/2007 Wilcox ..... A43B 23/24 24/3.1
2007/0094776 A1 * 5/2007 Stevens ..... A41F 9/002 2/338
2008/0060110 A1 * 3/2008 Schmelzer ..... A44B 1/32 2/69
2008/0141440 A1 * 6/2008 Taylor ..... A42B 1/248 2/209.12
2008/0263839 A1 * 10/2008 Stillwell ..... A43B 23/24 24/713.6
2009/0009711 A1 * 1/2009 Burnstein ..... G02C 11/02 351/52
2011/0047680 A1 * 3/2011 Hoying ..... A42B 3/16 2/425
2011/0088141 A1 * 4/2011 Davis ..... A42B 1/0184 2/195.1
2011/0145971 A1 * 6/2011 Norbert ..... A45C 13/08 2/244
2013/0117987 A1 * 5/2013 Rienecker ..... A41F 9/002 2/311

* cited by examiner

ATTACHMENT AND ATTACHMENT SYSTEM FOR A HELMET

CROSS-REFERENCE TO RELATED APPLICATIONS

This application is a continuation of U.S. application Ser. No. 14/339,455 filed Jul. 24, 2014, now U.S. Pat. No. 11,317,673 issued May 3, 2022, which claims the benefit of U.S. Provisional Application No. 62/004,745 filed May 29, 2014, the disclosures of which are hereby incorporated by reference in their entireties.

FIELD OF THE INVENTION

The present invention relates to an attachment and an attachment system for a helmet.

BACKGROUND

Helmets are used for protecting a person's head during, for example, a crash or a fall may happen. Helmets are used in a variety of different sports and occupations, such as, for example, bicycle riding, skiing, playing American Football, motorcycle racing, horse riding, ice hockey, fire fighting, etc. Such helmets are typically formed by well known processes and with well-known materials.

Users oftentimes desire to customize their possessions so as to show their individuality, tastes, affiliations, etc. Ornamental and functional attachments to clothing and garments are also well-known, for example, brooches which are pinned on clothing, and stickers for customizing possessions, and sewn-on or adhesive patches for apparel. For footwear, attachments are also known, such as insertable charms for shoes. For example, the popular, flexible Crocs™ shoes may be combined with "Crocs™ charms" such as those by Jibbitz™ (http://www.crocs.com/jibbitz-by-crocs-shoe-charms/jibbitz,default,sc.html) to decorate the shoes. In such a case, the Jibbitz™ crocs charms are formed of an ornamental piece permanently affixed to a hard plastic backing which contains a hard shaft and a hard round plug affixed to the shaft opposite the ornamental piece. The hard round plug is forcibly inserted through a hole in the flexible shoe. The edges of the hole deform to allow the hard wound plug to be inserted into the shoe. The hole in the flexible shoe then returns to its original shape and secures the ornamental piece to the shoe. In some cases the ornamental piece may be pulled out of the shoe by reversing the above process.

Helmet users may also wish to customize their helmets, but while the attachment method used for Crocs™ charms is appropriate for a soft, deformable shoe, a different system is needed for a helmet, which is typically, by necessity, hard and inflexible. Accordingly, there exists a need for an improved attachment and attachment system applicable to a hard helmet.

SUMMARY OF THE INVENTION

An embodiment of the present invention relates to an attachment for a helmet includes an external portion, an internal portion distal from the external portion, and a shaft extending between the external portion and the internal portion. The external portion contains an object to be attached to the helmet.

An embodiment of the present invention relates to a system for customizing a helmet containing a helmet having a protective shell, a hole piercing the external surface, and an attachment for the helmet. The protective shell contains an external surface, an internal surface opposite the external surface and a helmet thickness which is the distance between the external surface and the internal surface. The attachment has an external portion with an object, an internal portion and a shaft. The internal portion is distal from the external portion, contains a flexible edge and is insertable into the hole. The shaft extends between the external portion and the internal portion and is able to pass into the hole. The shaft has a length which is sufficient to allow the external portion to remain on the external surface while the attachment is affixed to the helmet. In an embodiment herein, the attachment is removably-affixable to the helmet.

Without intending to be limited by theory, it is believed that the attachment and the system herein may allow customization of a helmet securely and safely. Such a system may also allow any attachments to be easily adjustable, removable and/or modifiable by the user, and may further allow additional helmet functionality and/or modify the existing helmet properties such as aerodynamics.

BRIEF DESCRIPTION OF THE DRAWINGS

The present invention is illustrated by way of example in the accompanying drawings. The drawings should be understood as illustrative rather than limiting.

The figures herein are for illustrative purposes only and are not necessarily drawn to scale.

DETAILED DESCRIPTION

A system, method and apparatus is provided for an attachment and attachment system for a helmet. The specific embodiments described in this document represent exemplary instances of the present invention, and are illustrative in nature rather than restrictive.

In the following description, for purposes of explanation, numerous specific details are set forth in order to provide a thorough understanding of the invention. It will be apparent, however, to one skilled in the art that the invention can be practiced without these specific details. In other instances, structures and devices may be shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments.

Unless otherwise specifically provided, all tests herein are conducted at standard conditions which include a room and testing temperature of 25° C., sea level (1 atm.) pressure, and pH 7, and all measurements are made in metric units. Furthermore, all percentages, ratios, etc. herein are by weight, unless specifically indicated otherwise.

As used herein, the term "airfoil" indicates an object formed of any shape and/or material which reduces air drag on a helmet when affixed thereto by the method described herein.

Unless otherwise explicitly indicated, as used herein the terms "internal", "inner" and "inside" indicate a relative position towards the helmet portion which is or would be closer to the wearer's head. Unless otherwise explicitly indicated, as used herein the terms "exterior", "outer" and "external" indicate a relative position towards the helmet portion which is or would be closer to the outside of a helmet which is or would be away from the wearer's head.

In an embodiment herein, an attachment for a helmet includes an external portion, an internal portion distal from the external portion, and a shaft extending between the external portion and the internal portion. The external portion can be formed integrally with the shaft. The external portion contains an object to be attached to the helmet.

Figure 1:
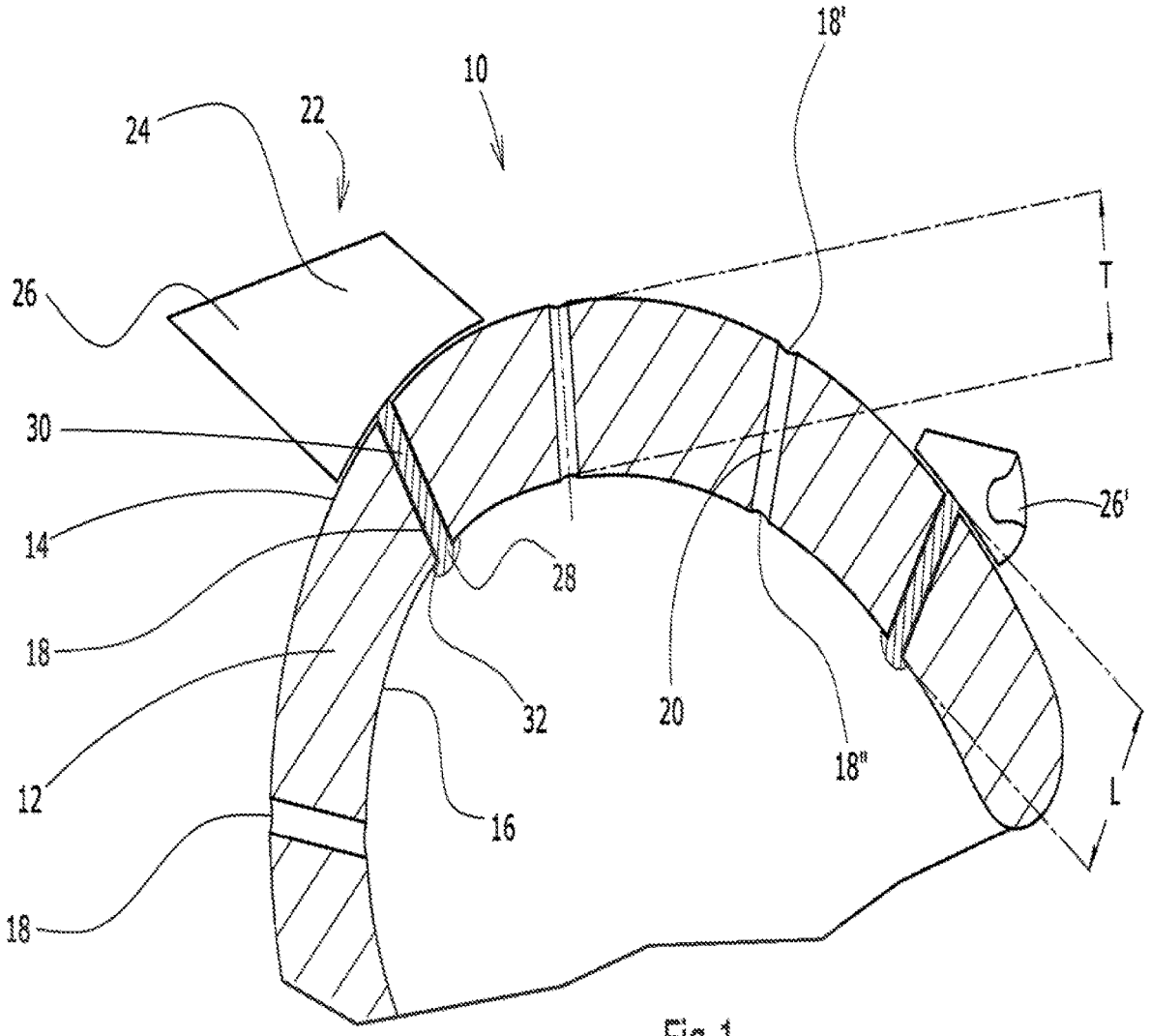
FIG. 1 shows a cut-away view of embodiment of the present invention.

Turning to the figures, FIG. 1 shows a cut-away view of a helmet, 10, having a protective shell, 12, containing an external surface, 14, and an internal surface, 16, opposite the external surface, 14. A plurality of holes, 18, pierce the protective shell, 12. In this embodiment, the holes, 18, have a hole, 18', in the external surface, 14 linked to a hole, 18", in the internal surface, 16, and thereby provide a conduit, 20, connecting the external surface, 14, and the internal surface, 16. The holes may be of any shape; or the holes may be circular. In an embodiment herein the holes are of a uniform shape and a uniform depth. In an embodiment herein the helmet contains from about 1 to about 100 holes; or from about 2 to about 50 holes; or from about 3 to about 40 holes. In an embodiment herein, the hole; or a plurality of holes, is formed perpendicular to the external surface. In an embodiment herein, the hole; or a plurality of holes, is not formed perpendicular to the external surface. In an embodiment herein, the helmet contains a hole; or a plurality of holes, that is formed perpendicular to the external surface and a hole; or a plurality of holes, that is not formed perpendicular to the external surface. In an embodiment herein, the helmet contains a hole; or a plurality of holes, perpendicular to the external surface located at the top (see FIG. 2 at 34) of the helmet. In an embodiment herein, the helmet contains a hole; or a plurality of holes, that are not perpendicular to the external surface located at a side (see FIG. 2 at 36) of the helmet. Without intending to be limited by theory, it is believed that both perpendicular and non-perpendicular holes may be useful for different types, locations and alignments of attachments. In an embodiment herein, the hole; or plurality of holes, goes all the way through from the external surface to the internal surface. In an embodiment herein, the hole; or plurality of holes, is a pit-type hole (see FIG. 2 at 38), which contains a hole in the external surface and a closed conduit (see FIG. 2 at 20') that does not go all the way through the protective shell to pierce the internal surface.

One skilled in the art recognizes that the helmet may have other additional optional openings such as for vents, chin strap connectors, padding connectors, etc. known in the art and that these additional optional openings are not to be confused with the specific "holes" described herein.

FIG. 1 shows an attachment, 22, having an external portion, 24, which further includes an object, 26. The external portion refers to the portion of the attachment which is located on the outside of the helmet, 10. In FIG. 1, the object, 26, is an airfoil which is intended to reduce air resistance and/or smooth out air turbulence during use, and especially at relatively higher speeds. The object, 26, may also be, for example, a light, 26', which may illuminate the area for the user. In an embodiment of the present invention the object may be an aesthetic decoration, such as, for example, a flower, a car, a geometric shape, an emoticon, an abstract design, a symbol, an alphabetic letter, a symbolic letter, a phonetic letter, a character (i.e., a doll or figurine, a person's face, an anime/cartoon character, etc.), a logo or trademark, a horn, and a combination thereof. In an embodiment of the invention, the object is selected from the group consisting of a light, a camera, an airfoil, an aesthetic decoration, and a combination thereof.

The attachment, 22, also contains an internal portion, 28, distal from the external portion, 24. A shaft, 30, connects the internal portion, 28 and the external portion, 24. Furthermore, in FIG. 1, the internal portion, 28, contains a flexible edge, 32, which is able to fit into the hole, 18', in the external surface, 14, through the conduit, 20, and out of the hole, 18", on the internal surface, 16. Typically, the internal portion is shaped to be wider in at least one dimension than the conduit and/or the hole so as to secure the attachment to the helmet. In an embodiment herein the internal portion is shaped to be wider in at least one dimension than the conduit and/or the hole. This may prevent the internal portion from undesirably releasing so that the attachment slips and/or falls off the helmet. In an embodiment herein the internal portion is shaped as a circle when viewed from the inside of the helmet. Such a circular shape may be especially useful when the hole is also in the shape of a circle. In an embodiment herein, the hole is circular in shape and from about 3 mm to about 20 mm in diameter; or from about 5 mm to about 17 mm in diameter; or from about 7 to about 15 mm in diameter. In an embodiment herein, the internal portion is circular in shape and from about 4 mm to about 30 mm in diameter; or from about 7 mm to about 25 mm in diameter; or from about 9 to about 20 mm in diameter. In an embodiment herein the surface area of the internal portion is from about 105% to about 250%; or from about 110% to about 220%; or from about 115% to about 200% of the surface area of the hole, when viewed from the inside of the helmet.

In an embodiment herein the internal portion is formed of a soft, flexible material selected from the group consisting of a thermoplastic resin, rubber, and a combination thereof. In an embodiment herein, the shaft is formed of a hard central stem formed of, for example, a hard plastic, around which is formed a softer, more flexible material such as a thermoplastic resin, rubber, etc. Such a shaft may be formed by, for example, co-moulding the stem with the desired materials. In such a case, the internal portion is typically completely formed by the softer, more flexible material.

In an embodiment herein the external portion is shaped to be wider in at least one dimension than the conduit and/or the hole. In an embodiment herein the external portion is shaped to be wider in at least one dimension than the conduit and/or the hole In FIG. 1, the helmet, 10, has a helmet thickness, T, which is the distance between the external surface, 14, and the internal surface, 16, as measured perpendicular to a line drawn tangent to the external surface, 14. In an embodiment herein, the helmet thickness is measured as the distance through the protective shell, via a hole on the external surface, through the conduit, and to a corresponding hole on the internal surface, as seen in FIG. 1. In the system herein, the shaft, 30, has a length, L, which is sufficient to allow the external portion, 24, to remain on the external surface, 14, while the internal portion, 28, simultaneously remains on the internal surface, 16. Thus, the external portion remains on the external surface while the internal portion affixes the attachment to the helmet. In an embodiment herein the internal portion rests on the internal surface. In an embodiment herein, the length of the shaft is at least as long as the helmet thickness. In an embodiment herein, the length of the shaft is from about 70% to about 125%; or from about 90% to about 110%; or from about 97% to about 105% of the helmet thickness. Even if the shaft length is less than the thickness, the internal portion may still rest on the internal surface because, for example, the external portion and/or the internal portion may stretch, especially if it is made from, for example, a thermoplastic resin or rubber. In an embodiment herein, even though the shaft length is less than the helmet thickness, the shaft itself is formed of a material which allows the shaft to stretch so that the internal portion still rests on the internal surface. In an embodiment herein, the shaft is shorter than the helmet thickness and therefore the internal portion does not protrude from the conduit; however, the internal portion is of such a size and shape that the flexible edge is wedged in the conduit so as to still affix the attachment to the helmet. Without intending to be limited by theory, it is believed that such a feature may be particularly useful as it may avoid catching hair in, on and/or around the internal portion.

Figure 2:
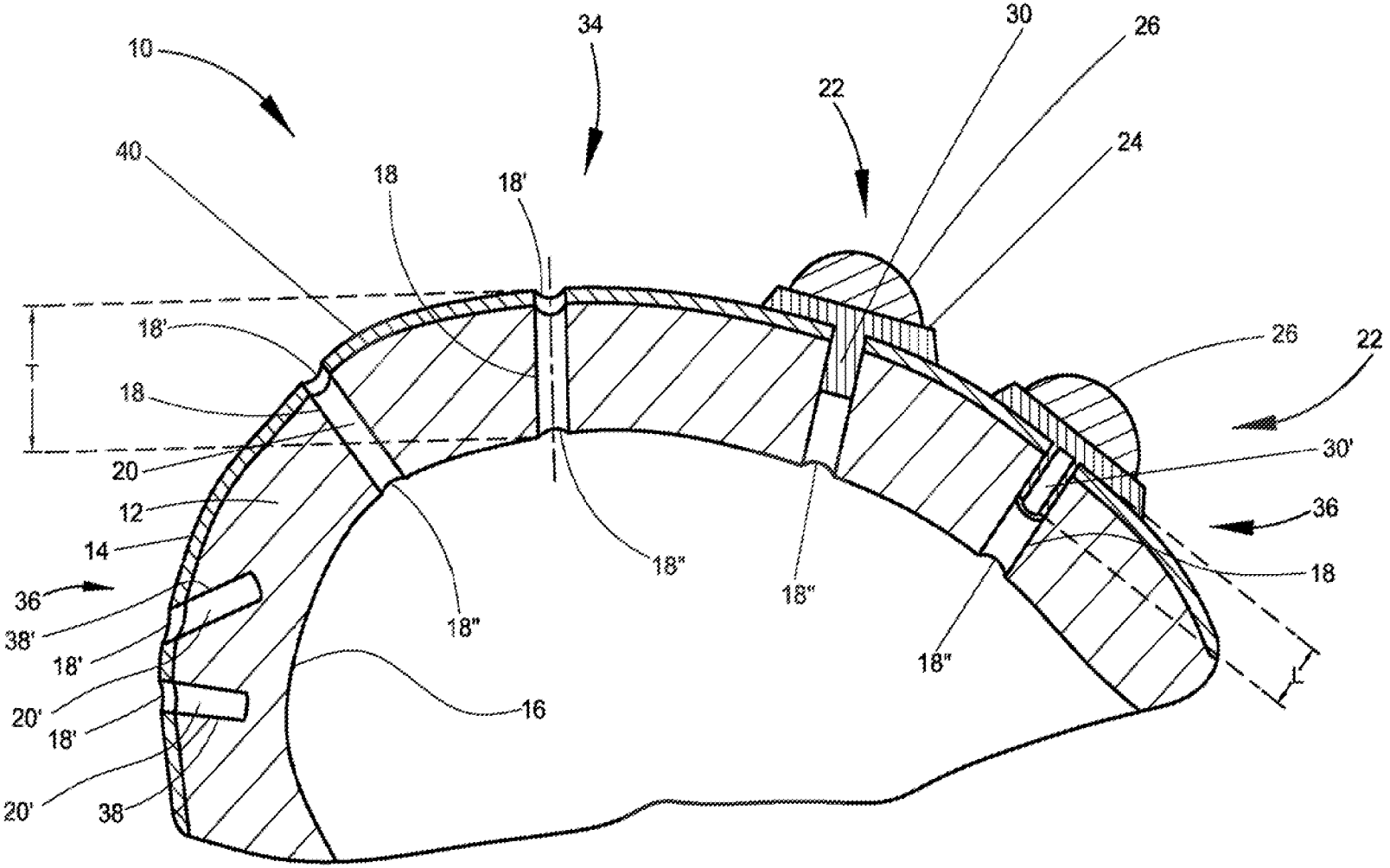
FIG. 2 shows a cross-sectional view of an alternative embodiment of the present invention.

FIG. 2 shows an alternate embodiment of the system herein with a helmet, 10, containing a plurality of holes, 18. In some of the holes, 18, the conduit, 20 goes all the way through the helmet, 10, from the hole, 18', in the external surface, 14, to the hole, 18", in the internal surface, 16. This is especially true for holes, 18, at the top, 34, of the helmet, 10, which tend to be formed perpendicular to the external surface, 14. However, this embodiment also contains holes, 18, located in the side, 36, of the helmet, which are perpendicular to the external surface, 14.

As used herein, the term "top", 34, of the helmet, 10, refers to the portion of the helmet, 10, external to and above the parietal ridge when worn by the typical helmet user. As used herein, the term "side", 36, of the helmet, 10, refers to the portion of the helmet, 10, external to and at, or below, the parietal ridge when worn by the typical helmet user. The side, 36, of the helmet may refer to the left side, right side, front side, and/or back side of the helmet as it is work by a user.

In FIG. 2, the side, 36, of the helmet, 10, also contains a pit-type hole, 38, which has a hole, 18', in the external surface, 14, and a closed conduit, 20', which does not pierce the internal surface, 16. In this embodiment, the two pit-type holes, 38 and 38', are located in the side, 36, of the helmet, 10, but such a depiction of the location for pit-type holes is not considered limiting in any way. in FIG. 2, a pit-type hole, 38, is roughly perpendicular to the external surface, 14, while another pit-type hole, 38', is not perpendicular to the external surface, 14.

It can also be seen that the attachments, 22, shown in FIG. 2 contain an external portion, 24 and an object, 26, which may be, for example, a bauble such as a plastic crystal. In this embodiment, the shafts, 30 and 30', do not extend all the way to the hole, 18", in the inner surface, 16. The shaft, 30, may be a solid shaft, 30, or a hollow shaft, 30'. Without intending to be limited by theory, it is believed that such a shaft design allows the attachment to be secure during regular use, and yet also easily removable, either in order to change the location of the attachment, and/or to allow the attachment to fall off during, for example, subject to shear forces in the unfortunate case of an accident or a crash. In an embodiment herein, the shaft is a hollow shaft which is believed to be especially useful to balance out the need for securing of the attachment during regular use, and the need for easy removability. In cases where the shaft is not hollow, then in an embodiment herein the shaft is made of a flexible material so as to allow easy removability. In addition, the shape and size of the shaft should be coordinated with the shape and size of the hole(s) so as to allow the balance between the desired releasability and the opposing fixation/securing properties.

In FIG. 2, the protective shell, 12, further contains an external layer, 40. This external layer, 40, will typically provide additional protection by either absorbing or dissipating impact. In an embodiment herein, the protective shell is formed of an impact-dissipating material covered by an external layer. Accordingly, the external layer may be formed of an impact-dissipating material such as, for example, a resin, a plastic, a rubber, a foam, and a combination thereof; or a resin, a plastic, and a combination thereof; or a plastic. Other impact-dissipating materials are well-known in the art and are typically selected from a polystyrene, a polypropylene, and a mixture thereof; or from an extruded polystyrene, an expanded polystyrene; expanded polypropylene, and a mixture thereof; or an expanded polystyrene, and a mixture thereof. Without intending to be limited be theory, we believe that these materials provide a good balance between factors such as cost, weight, durability, impact-dissipation, formability, stability across various temperature ranges, etc. Expanded polystyrene especially tends to be light and also able to withstand both high and low temperature extremes and maintain its physical shock-absorbing properties for use in, for example, skiing helmets as well as water sport helmets.

In an alternate embodiment herein, the external layer contains an outer hard shell containing an outer hard shell material selected from a polymeric material; or from a polycarbonate, a polystyrene, a polyacrylate and a mixture thereof; or from an extruded polystyrene, acrylonitrile butadiene styrene, an expanded polystyrene, and a mixture thereof; or acrylonitrile butadiene styrene, an expanded polystyrene; and a mixture thereof. Without intending to be limited by theory, it is believed that such a material may be brittle and crack or even shatter upon impact. Such a cracking or shattering, however, is believed to dissipate the impact, and therefore less force is transmitted through the helmet and towards the user's head.

If present, the external layer and the protective shell may be affixed to each other permanently or removably, by methods typically used and known in the art, such as adhesives, in-moulding, fasteners, etc. Typical fasteners include snap-fit fasteners, hook-and-loop fasteners, etc.

In an embodiment herein the attachment; or the object, is removably-affixed to the helmet. In an embodiment herein the internal portion is removably-affixed to the attachment; or the internal portion is removably-affixed to the object, for example, by a snap-fit fastener, a screw-type fastener, a magnetic fastener, and a combination thereof. In an embodiment herein the shaft is removable from the attachment, object and/or the internal portion, for example, by a snap-fit fastener, a screw-type fastener, a magnetic fastener, and a combination thereof. Without intending to be limited by theory, it is believed that such a feature may be especially useful as in some locations, the helmet safety and/or regulatory rules may require that any ornamental features be able to break off from the helmet, for example, during a crash. Alternatively, in an embodiment herein, the attachment itself may completely fall out of or off of the helmet so as to comply with the safety and/or regulatory rules.

In an embodiment herein, the attachment is designed so as to separate from the helmet during an impact, especially in an impact where shear forces act perpendicular to the external surface of the helmet.

In an embodiment herein, the object has a height of less than about 15 mm; or from about 0 mm to about 15 mm; or from about 1 mm to about 10 mm; or from about 1 mm to about 7 mm from the external surface, when measured to the farthest (or highest) point of the object, as measured perpendicular to a tangent drawn from the external surface. Without intending to be limited by theory, it is believed that such a feature may be especially useful as in some locations, safety and/or regulatory rules require that any ornamental features have a specific height or less; or a height of 7 mm or less.

In an embodiment herein, the helmet thickness is uniform where the hole(s) is (are) located. In an embodiment herein, plurality of holes with a plurality of conduits are located on a single helmet. In the system herein, the helmet thickness of the various helmets where the holes are located is uniform, so that the attachments may fit appropriately.

In an embodiment of the present invention the holes run substantially perpendicularly through the helmet, as measured from a line tangent to the external surface of the helmet.

In an embodiment herein, the helmet further comprises an additional component selected from the group consisting of a liner, a visor, a chin strap, a mesh, an air vent, padding, an outer hard shell, a protective shield, and a combination thereof. In an embodiment herein, in the inside the helmet, padding may be affixed thereto to rest between the helmet and a user's head to increase comfort, improve fit, absorb impact, etc. The padding may be affixed via, for example adhesives, in-moulding, fasteners, etc., either permanently or removably as desired.

Such features are well-known in the art. In an embodiment herein the helmet is formed by an in-moulding process.

In an embodiment herein the helmet comprises a hard outer shell, such as that formed of acrylonitrile butadiene styrene, and/or polystyrene, and an inner shell, such as that formed by expanded poly propylene, expanded poly styrene, and a combination thereof.

In an embodiment herein the helmet is formed from paper, such as cardboard; or corrugated cardboard; or corrugated cardboard and plastic.

In an embodiment herein, the hole on the external surface forms a closed conduit which does not pierce the internal surface of the protective layer. In such an embodiment, the shaft and the internal portion of the attachment may merely fit into the closed conduit, and may either touch the end of the closed conduit distal from the hole, or may not touch the end of the closed conduit distal from the hole. Without intending to be limited by theory, it is believed that such a design may be especially preferred when the helmet is intended to be water proof. Without intending to be limited by theory, it is also believed that such a feature may also be particularly useful as it may avoid catching hair in, on and/or around the internal portion.

In an embodiment herein, the external portion of the attachment may be constructed or designed so as to break off from the internal portion and/or the shaft in the case of an impact or due to shear forces perpendicular to the axis of the shaft. Without intending to be limited by theory, it is believed that such a feature is especially useful for safety reasons. It is believed that safety may be enhanced when the external portion of the attachment is designed to break off. This in turn reduces the chance that the user's neck will be twisted or subjected to additional stress due to the presence of the attachment, the angle of impact, etc. Such a break-off feature is especially desirable with attachments having a relatively larger external portion.

It should be understood that the above only illustrates and describes examples whereby the present invention may be carried out, and that modifications and/or alterations may be made thereto without departing from the scope and spirit of the invention.

It should also be understood that certain features of the invention, which are, for clarity, described in the context of separate embodiments, may also be provided in combination in a single embodiment. Conversely, various features of the invention which are, for brevity, described in the context of a single embodiment, may also be provided or separately or in any suitable subcombination.

Because the instant application is a continuation application, to the extent any amendments, characterizations, or other assertions previously made (in any related patent applications or patents, including any parent, sibling, or child) with respect to any art, prior or otherwise, could be construed as a disclaimer of any subject matter supported by the present disclosure of this application, Applicant hereby rescinds and retracts such disclaimer. Applicant also respectfully submits that any prior art previously considered in any related patent applications or patents, including any parent, sibling, or child, may need to be re-visited.

What is claimed is:

1. A system for customizing a helmet comprising:

A. a helmet comprising:

i. a protective shell comprising:

a. an impact-dissipating material;

b. an external layer comprising an outer hard shell having an external surface and covering the impact-dissipating material;

c. an internal surface opposite the external surface, and;

d. a helmet thickness being the distance between the external surface and the internal surface; and ii. a hole piercing the external surface, and B. an attachment for the helmet comprising:

i. an external portion comprising an object;

ii. an internal portion distal from the external portion wherein the internal portion is insertable into the hole; and iii. a shaft that is able to pass into the hole, and wherein the shaft is a hollow shaft, and a length of the shaft is shorter than the helmet thickness and does not extend all the way to the internal surface; and wherein the external portion breaks off of the shaft in an impact.

2. The system according to claim 1, wherein the object is selected from the group consisting of an ornament, a frame, an aerodynamic feature, and a combination thereof.

3. The system according to claim 1, wherein the attachment is removably-affixable to the helmet.

4. The system according to claim 2, wherein the internal portion is removably-insertable into the hole.

5. The system according to claim 1, wherein the shaft and the external portion are integrally-formed.

6. The system according to claim 1, wherein the protective helmet is selected from a bicycle riding helmet, a skiing helmet, an American Football helmet, a motorcycle racing helmet, a horse riding helmet, an ice hockey helmet, a fire fighting helmet and a combination thereof.

7. The system according to claim 1, wherein the length of the shaft is sufficient to allow the external portion to remain on the external surface while the attachment is affixed to the helmet.

8. A system for customizing a helmet comprising:

A. a helmet comprising:

i. a protective shell comprising:

a. an impact-dissipating material;

b. an external surface comprising an external layer covering the impact-dissipating material, wherein the external layer comprises an outer hard shell;

c. an internal surface opposite the external surface, and;

d. a layer of the impact-dissipating material between the external surface and the internal surface and having a helmet thickness being the distance between the external surface and the internal surface; and ii. a hole piercing the external surface, and B. an attachment for the helmet comprising:

i. an external portion comprising an object; and ii. a shaft that is able to pass into the hole, wherein the shaft is a hollow shaft and a length of the shaft is shorter than the helmet thickness and does not extend all the way to the internal surface, and wherein the external portion breaks off of the shaft in an impact.

9. The system according to claim 8, wherein the length of the shaft is sufficient to allow the external portion to remain on the external surface while the attachment is affixed to the helmet.

10. The system according to claim 8, wherein the attachment is removably-affixed to the helmet.

11. The system according to claim 8, wherein the protective helmet is selected from a bicycle riding helmet, a skiing helmet, an American Football helmet, a motorcycle racing helmet, a horse riding helmet, an ice hockey helmet, a fire fighting helmet and a combination thereof.

12. The system according to claim 8, wherein the shaft and the external portion are integrally-formed.

* * * * *